US011767086B1

(12) United States Patent
Rodriguez et al.

(10) Patent No.: US 11,767,086 B1
(45) Date of Patent: Sep. 26, 2023

(54) NON-CAPSIZING BOAT (WATER VESSEL)

(71) Applicants: Omar Rodriguez, Coral Gables, FL (US); Jose Rodriguez, Miami Springs, FL (US)

(72) Inventors: Omar Rodriguez, Coral Gables, FL (US); Jose Rodriguez, Miami Springs, FL (US)

( * ) Notice: Subject to any disclaimer, the term of this patent is extended or adjusted under 35 U.S.C. 154(b) by 0 days.

(21) Appl. No.: 16/717,789

(22) Filed: Dec. 17, 2019

(51) Int. Cl.
*B63B 43/04* (2006.01)
*B63B 35/00* (2020.01)

(52) U.S. Cl.
CPC ..... *B63B 43/04* (2013.01); *B63B 35/00* (2013.01)

(58) Field of Classification Search
CPC ..... B63B 43/04; B63B 35/00
See application file for complete search history.

(56) References Cited

U.S. PATENT DOCUMENTS 1,033,607 A * 7/1912 Mintz ..... 114/350

FOREIGN PATENT DOCUMENTS

CN 105857539 A * 8/2016

* cited by examiner

*Primary Examiner* — S. Joseph Morano
*Assistant Examiner* — Jovon E Hayes
(74) *Attorney, Agent, or Firm* — Christopher J. Vandam, PA; Chris Van Dam

(57) ABSTRACT

A boat with an inner cabin suspended on a rotating shaft inside an outer shell. The outer shell completely encloses the inner cabin. The inner cabin freely rotates on the shaft inside the outer shell to maintain an upright orientation in any sea condition. Optionally, a motor is provided between the inner cabin and outer shell to dampen rotation of the inner cabin.

2 Claims, 2 Drawing Sheets

NON-CAPSIZING BOAT (WATER VESSEL)

Field of Invention: The Invention relates to a water craft or vessel/ Boat

BACKGROUND

Figure 1:
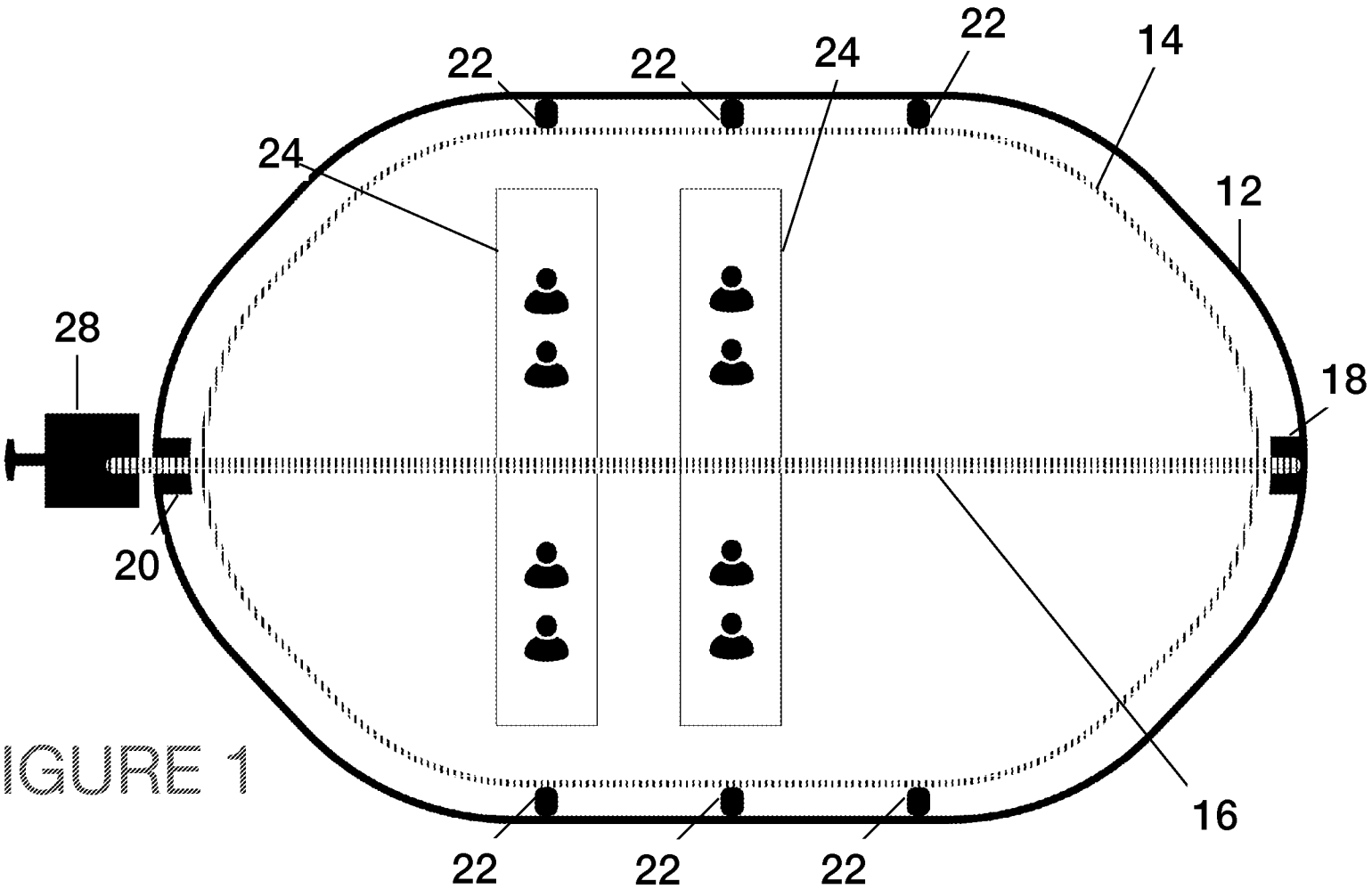
FIG. 1 shows a side elevation view of a non-capsizeable boat.
Figure 2:
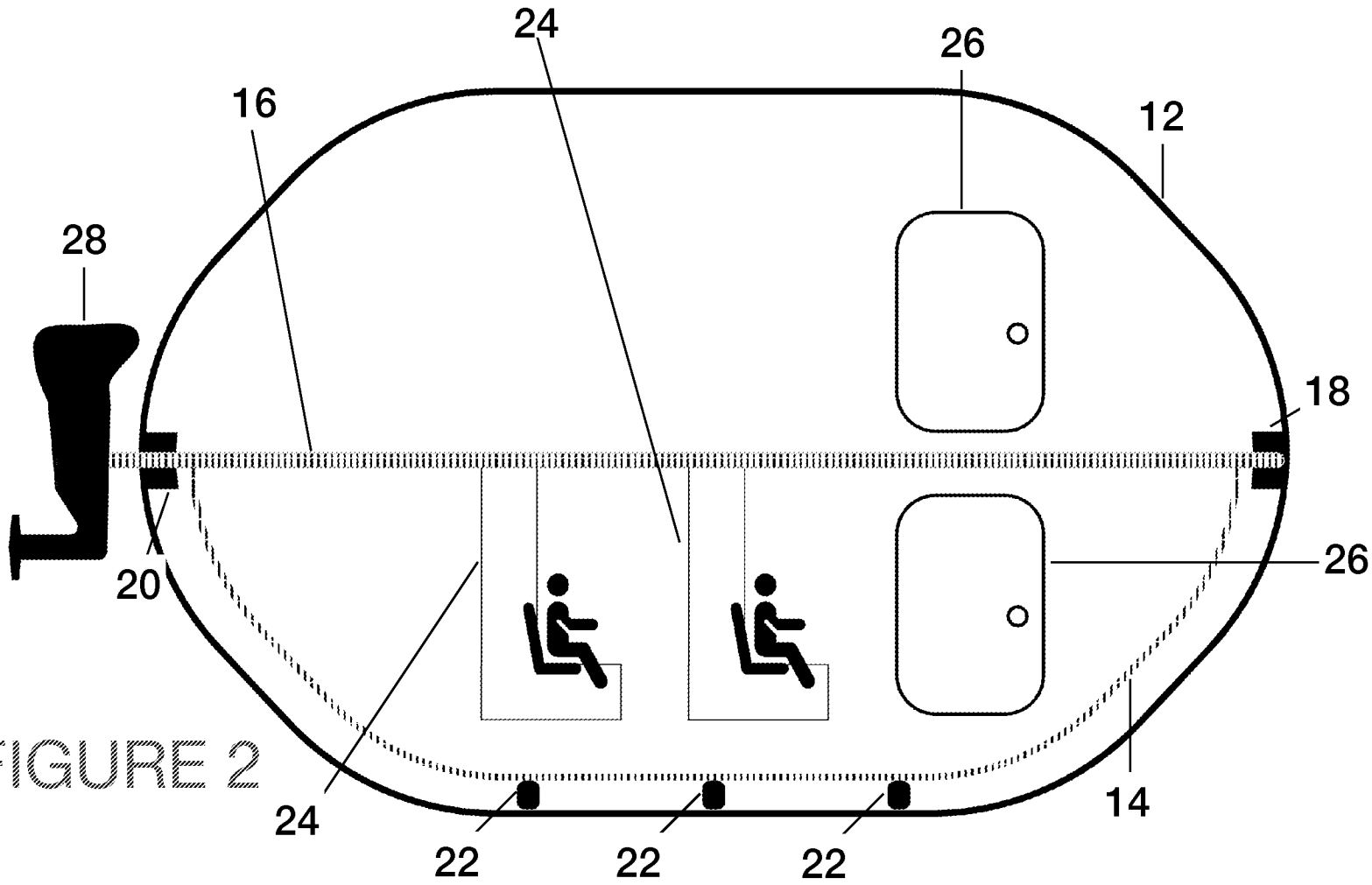
FIG. 2 show a top plan view of the non-capsizeable boat.

This invention is designed to prevent rough seas from capsizing the vessel and ejecting the passengers from the boat. Presently there is no design that allows passengers on a boat from maintaining level within a boat experiencing rough seas and preventing the water craft from capsizing. This vessel will always maintain afloat and allow the passengers to remain level with the water no matter the seas rough conditions.

THE SOLUTION: THE SUMMARY OF THE INVENTION

This invention is a boat/water crafft that will not capsize. The Boat/water vessel is designed to have an outer shell and an inner vabin resting on the freely rotating outer shell. This craft will always maintain the passenger level at all times, as theouter shell rotates to conform to the rough seas or water conditions. The Vessel will not capsize because it is completely enclosed and will no flip. The passengers will always be level with the assistance of gravity and small motors that can dampen and assist in making small corrections for very abrupt and changing sea condition.

The drawings are shown to include, among other features, an outer shell 12, an inner cabin 14, a shaft 16, a bearing 18, a bearing 20, motorized wheels 22, seating 24, doors 26 and a motor 28.

BASIC DESCRIPTION - HOW IT WORKS

The vessel is designed to have an outer rotating shell with an inner shell that has a compartment for seating. The inner shell is set on a shaft that allows the inner cabin to ride on an outer shell that rotates and allows the inner cabin to always stay completely level. The outer shell completely covers the inner shell and rotates. The inner cabin is suspended by a shaft that rests on ball bearing at the forward and aft portions on the boat. The outer shell supports the inner cabin and allows it to rotate. No matter what the sea conditions - the vessel will not capsize. The inner shell will always remain level and the outer shell will rotate depending o the conditions of the water. The inner cabin and outer shell can be also balanced and managed with small wheels driven by small motors - they can regulate the movement and control how quickly the outer shell and the inner cabin interact with one another. The motors can dampen the rotation and maintain a smooth ride for passengers.

We claim:

1. A non-capsizing boat comprising:

an outer shell and an inner cabin;

the outer shell completely surrounds the inner cabin;

the outer shell has a door dimensioned for human egress;

the inner cabin has an interior volume with passenger seating;

a first end of a shaft is attached to an interior aft end of the outer shell with a first rotating bearing;

a second end of the shaft is attached to an interior fore end of the outer shell with a second rotating bearing;

the shaft passes through the interior volume of the inner cabin;

the inner cabin is suspended by the shaft inside the outer shell;

the inner cabin freely rotates on the shaft inside the outer shell so that when an orientation of the outer shell rotates, the inner cabin remains in a level orientation.

2. The boat of claim 1 further characterized in that a motor is operatively disposed between and connects the outer shell and inner cabin that dampens abrupt changes in orientation of the inner cabin relative to the outer shell.

* * * * *